United States Patent [19]

Avella et al.

[11] 4,383,375

[45] May 17, 1983

[54] DRAFTING APPARATUS

[75] Inventors: Frank S. Avella, Irvine; Charles Matthews, San Clemente, both of Calif.

[73] Assignee: Plan Hold Corporation, Irvine, Calif.

[21] Appl. No.: 240,852

[22] Filed: Mar. 5, 1981

[51] Int. Cl.[3] ..... B43L 13/02

[52] U.S. Cl. ..... 33/437; 33/449; 33/430; 33/DIG. 1

[58] Field of Search ..... 33/438, 433, 434, 437, 33/449, 474, 479, 430, DIG. 1; 308/3.6

[56] References Cited

U.S. PATENT DOCUMENTS

| | | | |
|---|---|---|---|
| 475,350 | 5/1892 | Shiley | 33/433 |
| 694,389 | 3/1902 | Klitsche | 33/437 |
| 1,639,580 | 8/1927 | Thompson | 33/437 |
| 2,501,296 | 3/1950 | Tyler | 33/430 |
| 2,568,575 | 9/1951 | Wickman | 33/437 |
| 3,137,072 | 6/1964 | Terry | 33/437 |
| 3,537,183 | 11/1970 | Anderson | 33/437 |
| 4,138,176 | 2/1979 | Cowdroy | 308/3.6 |

FOREIGN PATENT DOCUMENTS

| | | | |
|---|---|---|---|
| 1247612 | 10/1960 | France | 33/437 |
| 1294691 | 4/1962 | France | 33/437 |
| 768399 | 2/1957 | United Kingdom | 33/437 |

OTHER PUBLICATIONS

Advertisement Publication Entitled "Mockel Magnetic T. Square with Automatic Brake".

*Primary Examiner*—Willis Little

*Attorney, Agent, or Firm*—Poms, Smith, Lande & Rose

[57] ABSTRACT

A drafting apparatus for use with a drawing board having a side edge portion and a planar drawing surface in which a guide track extends in spaced relation to the side edge of the board and is mounted from the board for adjustment into several different positions in relation to the board. A T-square having a head body member provided with wheels for rolling engagement with the guide track and carrying a strip of material serving as an armature for coaction with a pair of spaced magnets carried by the head member of the T-square. The magnets are carried on a bar member provided with pivotal movement about a longitudinal horizontal pivot axis parallel to the side edge of the board, the magnet carrying bar member having an actuator portion for releasing the magnets from the armature strip. A slidable lock element is carried by the actuator portion to lock the magnet carrying bar member in release position if desired. A T-square head portion having supporting wheels mounted for adjustment relative to the head body portion to accommodate the T-square blade to different thicknesses of graphic media used on the drawing board. A drawing board provided with a support frame providing angular adjustment of the board.

28 Claims, 30 Drawing Figures

Fig. 4.
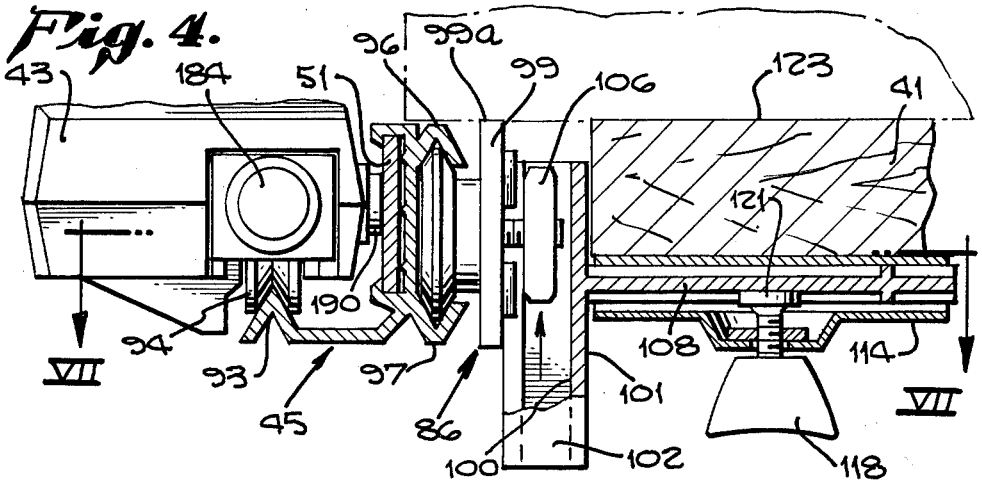
Fig. 5.
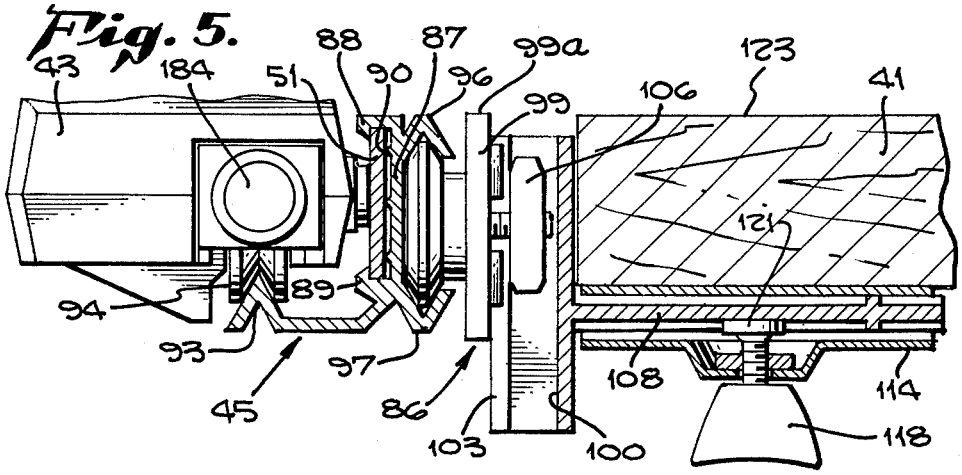
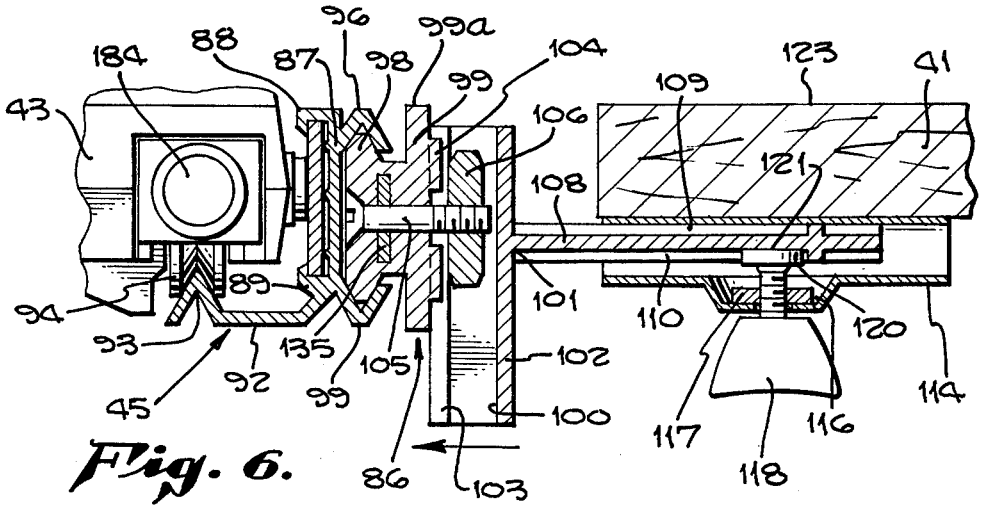
Fig. 6.

45
42
133
147
X
146
51
145
138
144
150
143
VIII
VIII
140
134
141
136
93
104
102
100
106
98
99
X
135
86
97
87
190
155
159
156
184
51
IX
IX 51
144
145
146
45

114
120
108

159
96
51
155
87
156
93
97
45

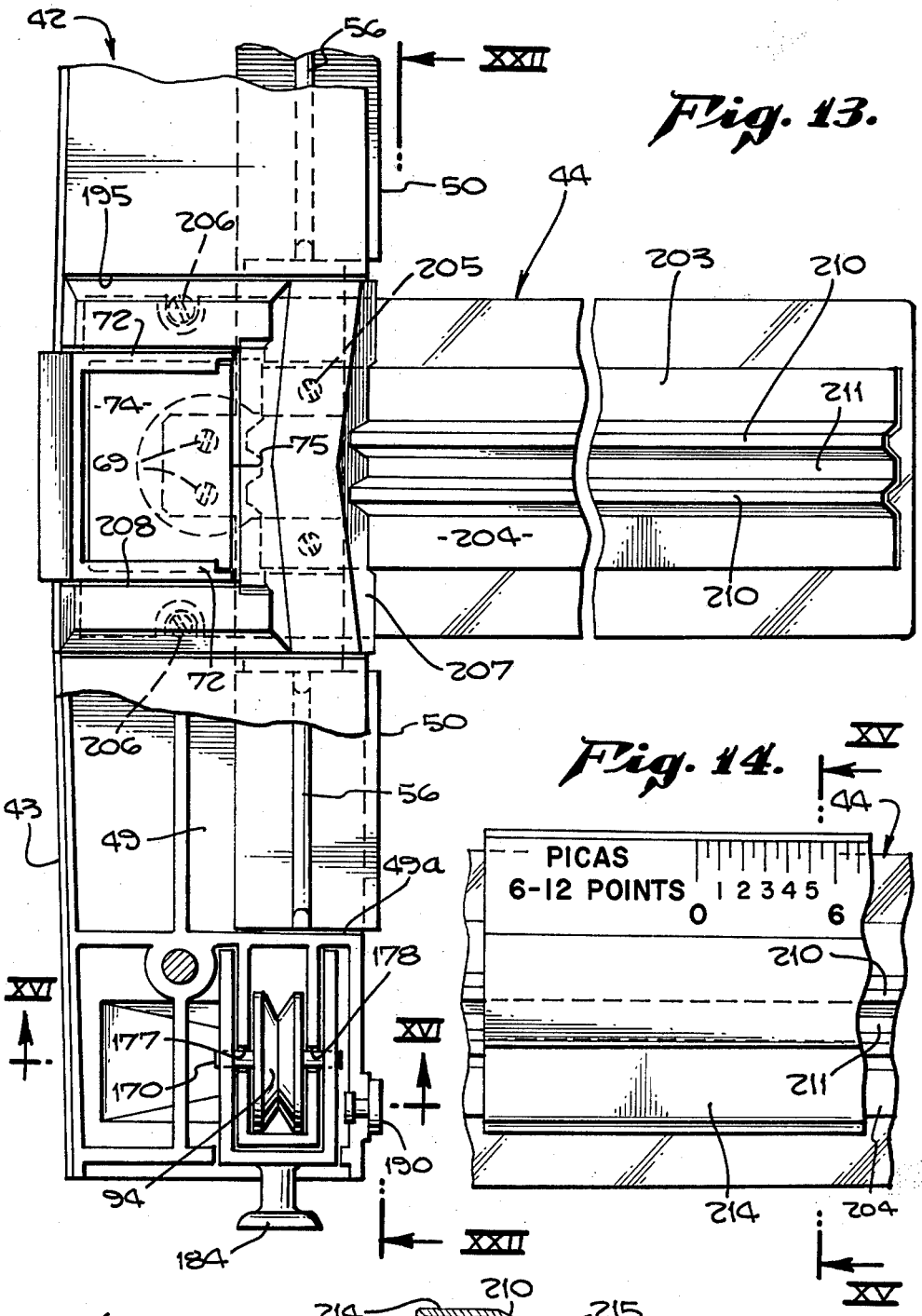
Fig. 13.
Fig. 14.
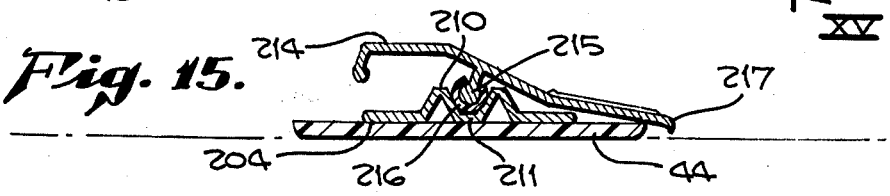
Fig. 15.

Fig. 16.
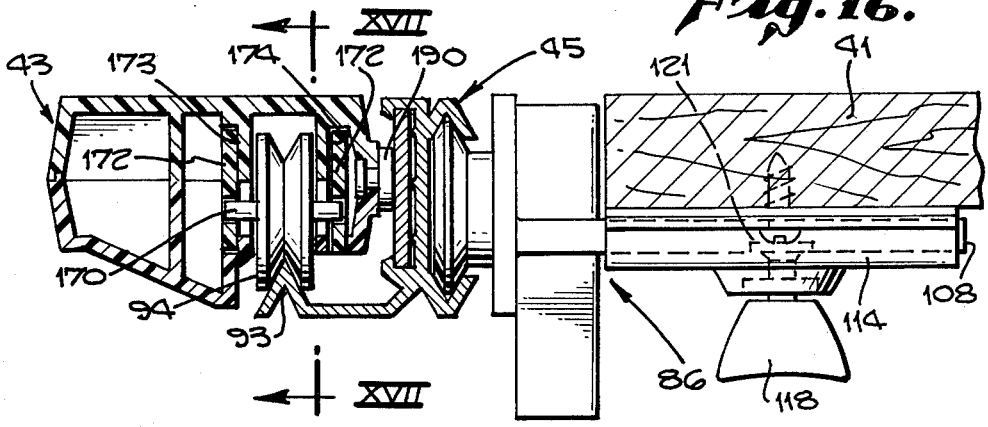
Fig. 17.
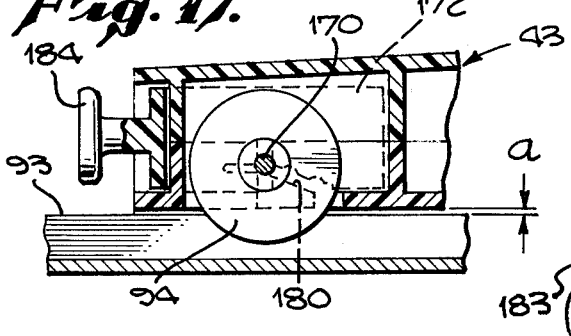
Fig. 20.
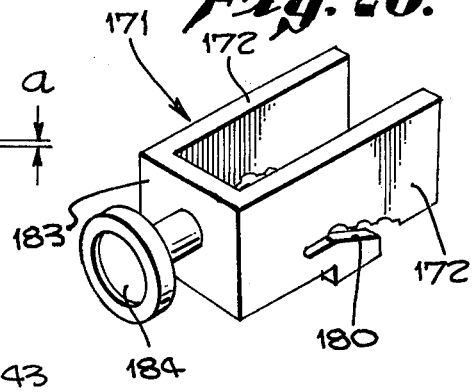
Fig. 18.
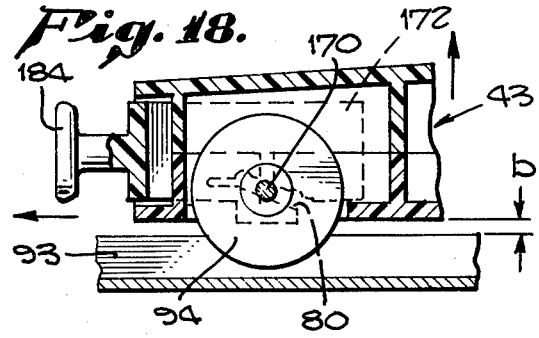
Fig. 21.
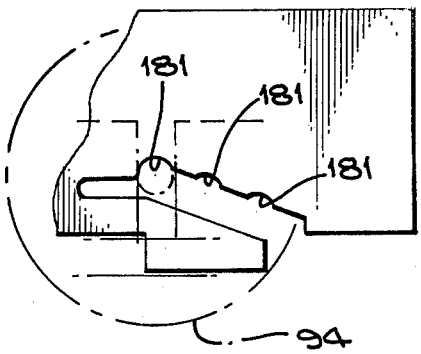
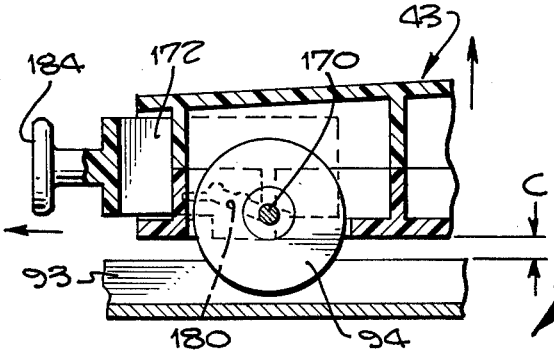
Fig. 19.

DRAFTING APPARATUS

BACKGROUND OF THE INVENTION

The present invention relates to drafting apparatus and particularly to a drawing board and an associated T-square means of novel construction. A T-square comprises a head portion having an edge adapted to slide along a side edge of a drafting board and a blade portion secured to the head portion in fixed 90° relation and overlies the drafting board surface to facilitate the drawing of straight lines. The relationship of the T-square to the drawing board is very important to the draftsman to facilitate his work.

Prior proposed T-square and drafting board combinations have included the use of magnet means on the T-square head portion to facilitate retention of the T-square in a selected position. In such prior proposed construction, the edge of the board was provided with a strip of magnet material and the head portion of the T-square had mounted thereon magnets in different arrangements and cooperable with the strip of magnetic material. One such prior construction is shown in U.S. Pat. No. 1,245,821. In British Pat. No. 768,399, published Feb. 13, 1957, an eccentric was provided in the T-square head portion to provide a variable air gap between the magnet and the armature to vary the holding power of the magnets. Another prior magnetic T-square construction is shown in U.S. Pat. No. 1,642,232. In U.S. Pat. No. 3,137,072 a T-square is provided with horseshoe magnets arranged around rollers which engage the side edge of a drawing board provided with an armature strip. In such prior proposed constructions, the armature strip and the magnet means cooperated in expected manner for holding and stabilizing the relationship of the T-square with respect to the drawing board.

Further, combinations of T-square and drawing boards known to me always required that the side edge of the drawing board be used as the guide surface for the head portion of the T-square.

SUMMARY OF THE INVENTION

The present invention contemplates a novel arrangement of a T-square and drawing board in which a guide track is used for guiding the T-square, the track means being readily adjustable in relation to the side edge portion of the drawing board to adapt the T-square and guide track combination to various conditions. Such conditions include drafting boards of different thickness, drawing materials of different thickness which may be used on the drafting board surface, effective use of the T-square at top and bottom margins of the drawing board, alignment of the T-square blade portion with a reference line on a drawing on the drawing board surface, use of the T-square blade portion as a guide for a ruler, and holding the T-square in a selected position by magnet means, and holding the magnet means in release position for free movement of the T-square along the guide track.

The primary object of the present invention is to disclose a novel drafting apparatus embodying a T-square and guide track readily associated with a drawing board and adapted to readily and conveniently meet the several conditions mentioned above.

An object of the invention is to disclose a novel construction of a T-square means utilizing magnets.

Another object of the invention is to disclose a novel guide track means which may be readily mounted on a drawing board in desired relationship with the drawing surface and side edge portion of the board.

Another object of the invention is to disclose a novel mounting means for such a guide track means in which accurate alignment of the guide track means is readily provided with the top surface of the board and by which the guide track means may be displaced relative to the side edge portion of the drawing board to meet various drafting conditions.

Another object of the invention is to disclose and provide a novel construction of a T-square means in which the head portion is provided with spaced wheels for rollable engagement with a guide track to facilitate smooth accurate movement of the T-square along the edge of the drawing board.

A further object of the invention is to disclose and provide a novel T-square construction as mentioned hereinabove in which the wheels of the T-square are readily shifted in relation to the T-square to provide adjustment of the T-square blade to various thicknesses of drawing material placed upon the drawing surface of the drawing board.

Still another object of the present invention is to provide a novel T-square construction utilizing spaced magnets in which the spaced magnets are mounted on a single member which is movable about a longitudinal axis to vary the holding power of the magnet with respect to an armature strip carried by guide track means.

A still further object of the invention is to disclose such a T-square construction utilizing magnets in which the magnet carrying member is provided with an upstanding actuator portion readily manipulated by a finger of the draftsman to cause release or locking of the magnets with respect to the armature strip on a guide track means.

A still further object of the invention is to provide a novel T-square construction utilizing magnet means as mentioned above and in which a finger actuated slide lock member is movable for holding the magnet carrying member in magnet release position.

The present invention also contemplates a novel support for a drafting board for varying the inclination of the board with respect to a surface.

The present invention contemplates a drafting apparatus in which the combination of a T-square means and a guide track means therefor is mounted on a drafting board in novel manner and in which such arrangement provides advantages and benefits to a draftsman heretofore not available.

Various objects and advantages of the present invention will be readily apparent from the following description of the drawings in which an exemplary embodiment of the invention is shown.

IN THE DRAWINGS

FIG. 4 is an enlarged fragmentary sectional view taken in the vertical plane indicated by line IV—IV of FIG. 1 and showing mounting means for associating said apparatus with drafting boards of different thickness.

FIG. 5 is a fragmentary sectional view taken in the same plane as FIG. 4 and illustrating adjustment of the apparatus to a board of thickness different than that shown in FIG. 4.

FIG. 6 is an enlarged fragmentary sectional view taken in the same plane as FIGS. 4 and 5 and illustrating adjustment of the apparatus to a board of still different thickness.

FIG. 13 is a top view of said apparatus at the connection of the T-square head body member to the T-square blade, portions of the head body member being broken away to show the means for adjusting the T-square to differences in thickness of drawing material used on the drawing board.

FIG. 14 is a fragmentary top plan view of the blade member of the T-square and a rule and cutting edge slidable therealong.

FIG. 15 is a vertical sectional view taken in the plane indicated by line XV—XV of FIG. 14.

FIG. 16 is a fragmentary enlarged sectional view taken in the vertical plane indicated by line XVI—XVI of FIG. 13, and showing an elevational view of the mounting means.

FIG. 17 is an enlarged fragmentary sectional view taken in the plane indicated by line XVII—XVII of FIG. 16 showing adjustment of the T-square for a thin material on the drawing board.

FIG. 18 is a sectional view similar to view 17 but showing the adjustment for a slightly greater thickness of material on the drawing board.

FIG. 19 is a fragmentary sectional view similar to FIGS. 17 and 18 and showing adjustment of the T-square for a greater thickness of material on the drawing board.

FIG. 20 is a perspective view of the yoke member providing the adjustments shown in FIGS. 17–19.

FIG. 21 is an enlarged fragmentary elevational view showing the steps of the yoke member.

DETAILED DESCRIPTION OF THE INVENTION

Figure 1:
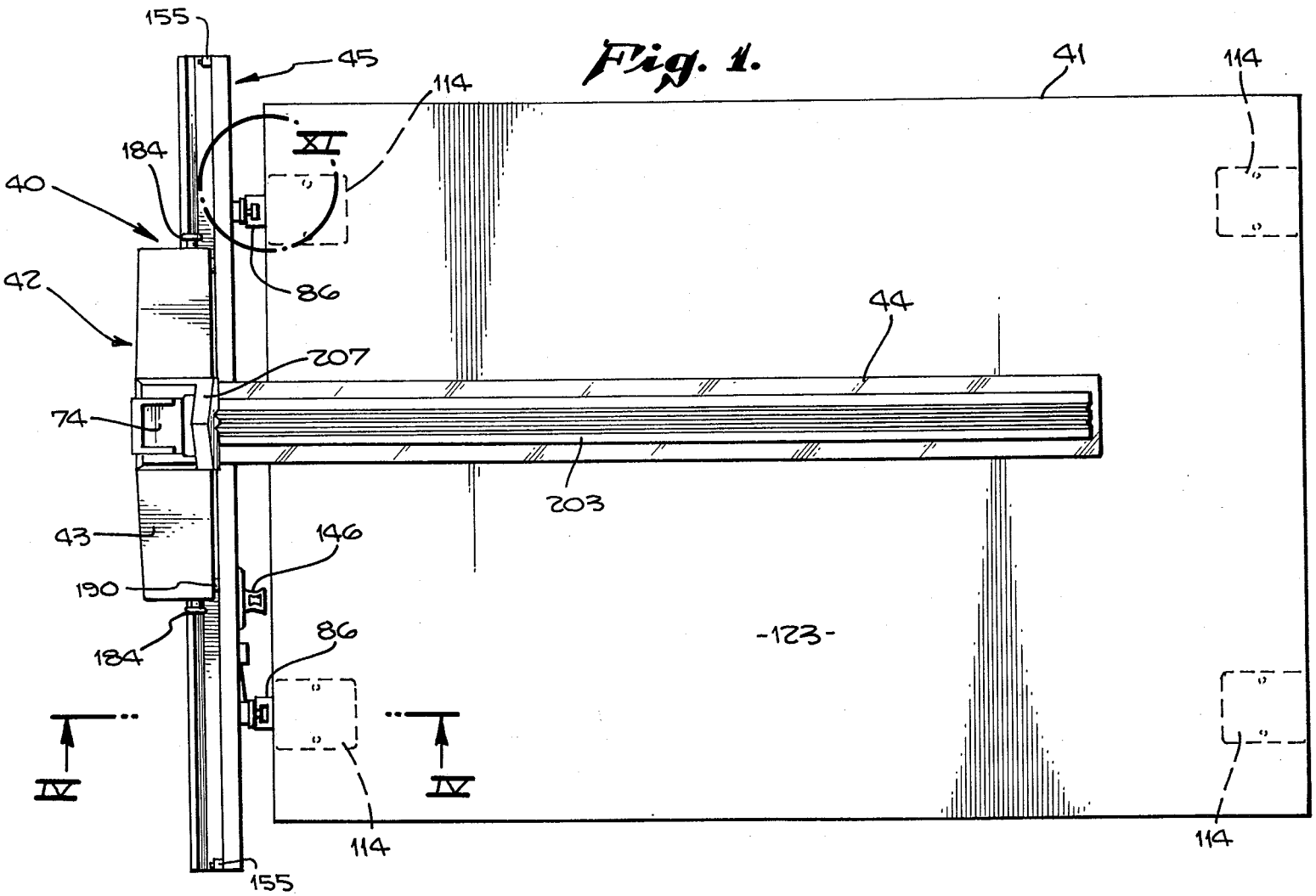
FIG. 1 is a top plan view of a drawing board or table equipped with the drafting apparatus of this invention.

A drafting apparatus embodying this invention is generally indicated at 40, FIG. 1, and is shown applied to the left side edge of a rectangular drawing board 41 of usual construction. Apparatus 40 generally comprises a novel T-square 42 including a base or head body member 43 provided with a blade member 44 in 90° relationship therewith, and guide track means 45. Drafting apparatus 40 is constructed to provide novel features particularly useful for draftsmen, such novel features including (1) magnet means on head member 43 for magnetically holding the T-square in a selected position relative to track means 45 and board 41;

(2) unitary release means on the head member to break the magnetic holding force for repositioning the T-square;

(3) lock means for holding the release means in a magnetic means release position for freely moving the T-square along the guide track means 45;

(4) means to angularly adjust the guide track means 45 with the edge of the drawing board to align the blade 44 with a reference line on a drawing on the board;

(5) means to longitudinally adjust the guide track means 45 relative to the board to facilitate use of the T-square 42 at top and bottom margins of the board;

(6) means to vertically adjust the track means 45 relative to the board 41 to accommodate the drafting apparatus 40 to boards of different thickness;

(7) means to vertically adjust the head body member 43 relative to the track means 45 to accommodate the blade 44 to drawing media or material of different thickness used on the board 41;

(8) and means providing a novel stand or support for the board to vary inclination of the board and to lock the board in a selected inclined position.

Other novel features of the drafting apparatus and its construction will be apparent in the following description.

MAGNET MEANS

Figure 22:
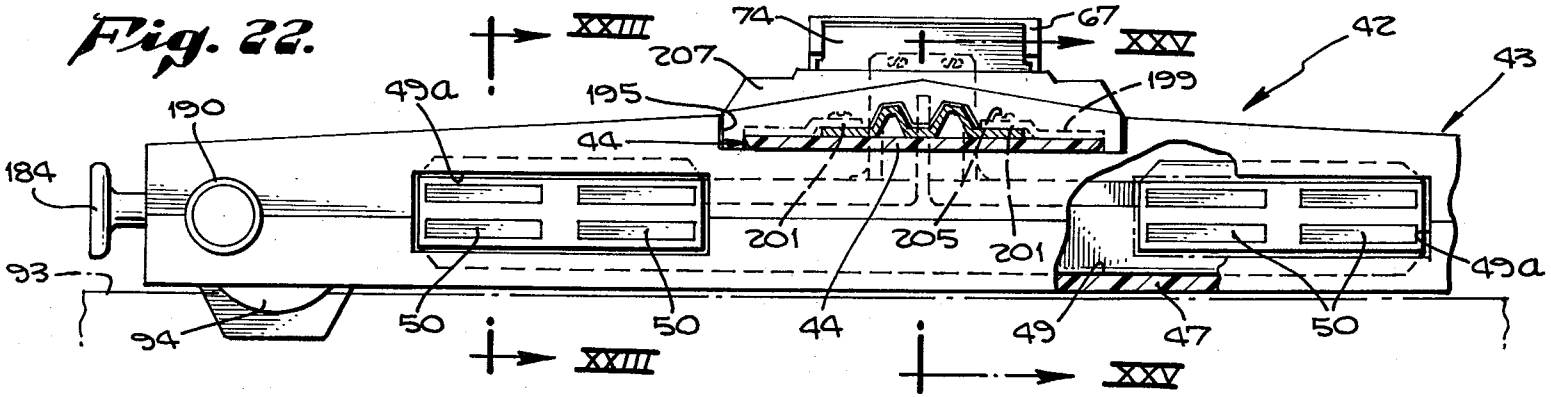
FIG. 22 is a fragmentary sectional view taken in the plane indicated by line XXII—XXII of FIG. 13, a portion of the head body member being broken away at the right of FIG. 22 to show the magnet mounting.

The magnet means of the invention are best shown in FIGS. 22–27, inclusive. In FIG. 22, T-square head body member 43 may comprise a bottom body portion 47 and a top body portion 48 of suitable molded plastic construction and with suitable internal reinforcing ribs, only some of which are shown. Body member 43 provides a central longitudinally extending chamber 49 provided with two spaced elongated rectangular openings 49*a* in the wall facing the blade 44 through which project face portions of spaced magnets 50. The magnets are of bar type and magnetically cooperate with a thin strip 51 of magnet material carried by guide track means 45 as later described.

Figure 24:
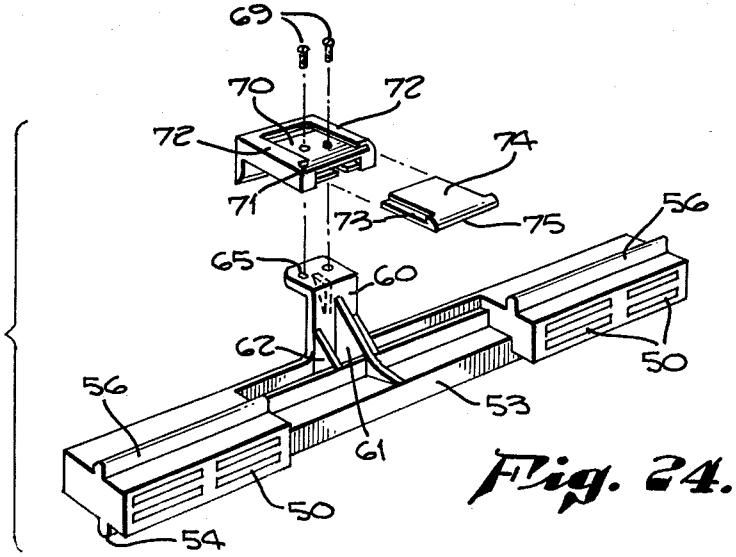
FIG. 24 is an exploded perspective view of the magnet carrying bar and actuating assembly.
Figure 26:
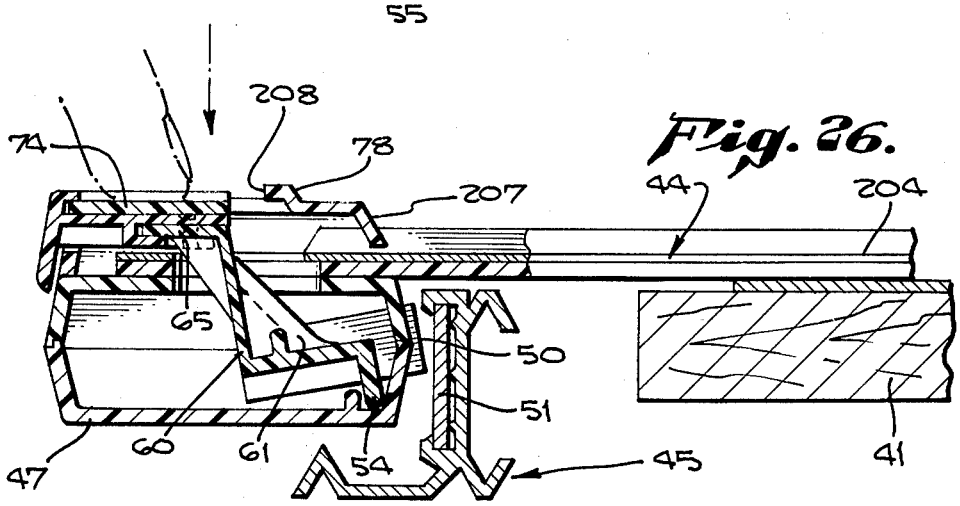
FIG. 26 is an enlarged fragmentary sectional view taken in the same plane as FIG. 25 and illustrating release of the magnet bar from the armature strip on the track means.
Figure 27:
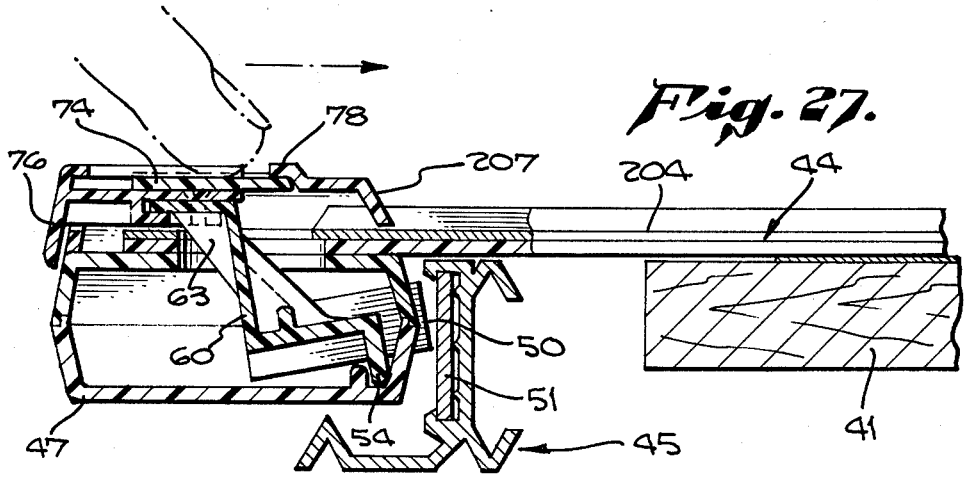
FIG. 27 is a fragmentary enlarged sectional view taken in the same plane as FIG. 25 and illustrating the lock means for holding the magnet bar in released position.

Spaced magnets 50 are carried at opposite ends of an integral magnet carrying bar 53, FIG. 24. Bar 53 may be made of suitable molded plastic material and includes a longitudinally extending bottom pivot rib 54 cooperable with a longitudinal recess 55 provided in the bottom wall of body portion 47 for pivotal mounting movement of bar 53 about a pivot axis longitudinally parallel to track means 45. The upper surface of bar 53 is provided with spaced upstanding longitudinally extending positioning ribs 56 which serve as a stop as at 57 with depending rib 58 of upper body portion 48 to position the faces of magnets 50 in parallel contact relation to armature strip 51. Such pivotal mounting of bar 53 in body member 43 provides counterclockwise movement of bar 53 about pivot rib 54 to permit disengagement of magnets 50 from armature strip 51 as shown in FIGS. 26, 27.

For activating pivotal movement of bar 53 as described above, bar 53 is provided with an upstanding integral actuator portion 60 at the central portion of bar 53. Actuator portion 60 is suitable reinforced by gussets 61, 62 and gusset 63 on the back face of the wall forming actuator portion 60 which terminates in a top laterally extending tab 65 adapted to be received within a recess 66 provided in a lock cap 67. The bottom wall of recess 66 is slotted at 68 to receive gusset 63. Lock cap 67 may be secured to tab 65 by suitable screws 69 as indicated in FIG. 24.

Lock cap 67 includes transverse wall 70 forming the upper wall of recess 66. Around the side and back margins of wall 70, lock cap 67 is provided with a peripheral channel 71 defined by inturned peripheral flanges 72. Channel 71 slidably receives rabbeted side edges 73 of a slidable lock element 74 having a curved or tapered front edge 75. Lock cap 67 includes a depending back flange 76 cooperable with upper body portion 48 in overlying relation as shown in FIGS. 26 and 27.

Figure 23:
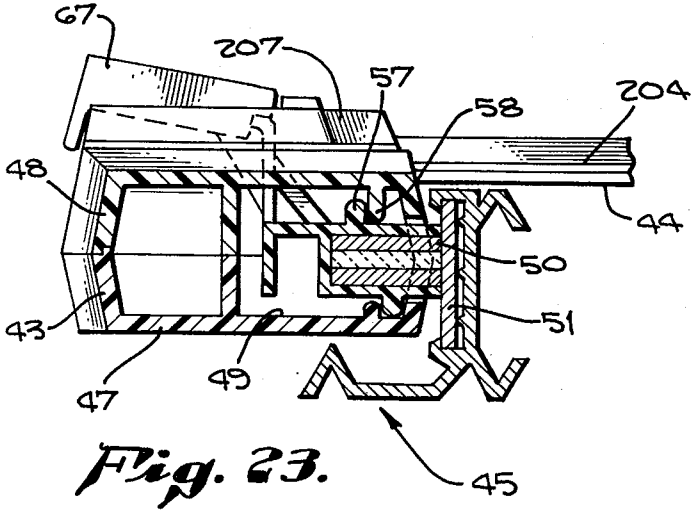
FIG. 23 is a fragmentary sectional view taken in the plane indicated by line XXIII—XXIII of FIG. 22.
Figure 25:
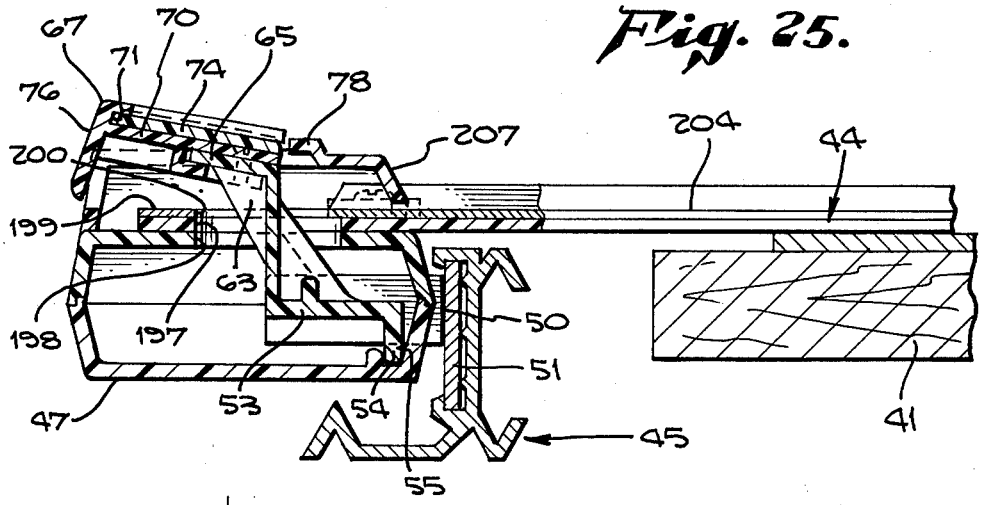
FIG. 25 is an enlarged fragmentary vertical sectional view taken in the plane indicated by line XXV—XXV of FIG. 22.

In magnetic holding position of the T-square 42 with respect to track means 45 as shown in FIGS. 23 and 25, actuator portion 60 positions tab 65 slightly upwardly inclined, cap 67 is correspondingly inclined, and slide lock element 74 is fully withdrawn within the channels 71 so that the forward curved edge 75 is spaced from an upwardly offset lip 78 on a shroud or cover 207. Cover 208 has a top opening 208 providing access to lock element 74.

As shown in FIG. 26, manual depression of actuator portion 60 by application of a finger to the top surface of slide lock element 74 will cause pivotal movement of magnet bar 53 about pivot rib 54 to move the magnet faces on magnets 50 away from and at an angle to armature strip 51. With the magnet holding force decreased by such separation, the T-square may be freely moved along guide track means 45 as more fully described later.

To hold the slide lock element 74 in such magnetic bar release position as shown in FIGS. 26 and 27, the element 74 may be manually pressed forwardly to slide the curved edge 75 of lock element 74 underneath the upwardly offset lip 78, FIG. 27. In such locked release position, the T-square may be readily freely moved along guide track means 45 and held in such release position without further manual application of a finger to the slide lock 74.

The unitary construction of the magnet bar 53 and actuator portion 60, together with the secured lock cap 67 and slidable lock element 74 provides a positive effective means for magnetically holding the T-square in selected position or in locked release position with a minimum of parts. The magnets 50 on magnet bar 53 are normally readily positioned by magnetic force and the magnetic force is sufficient to adequately hold the T-square in position relative to a drawing board when the drawing board is in its maximum inclined position. Momentary release of the magnets is positively accomplished by manual depression of lock cap 67. As described above, manual forward sliding of the lock element 74 underneath the retaining lip 78 of cover 207 conveniently retains the magnet bar 53 in pivoted release position if freedom of movement of the T-square is desired.

ANGULAR ADJUSTMENT OF T-SQUARE

Figure 2:
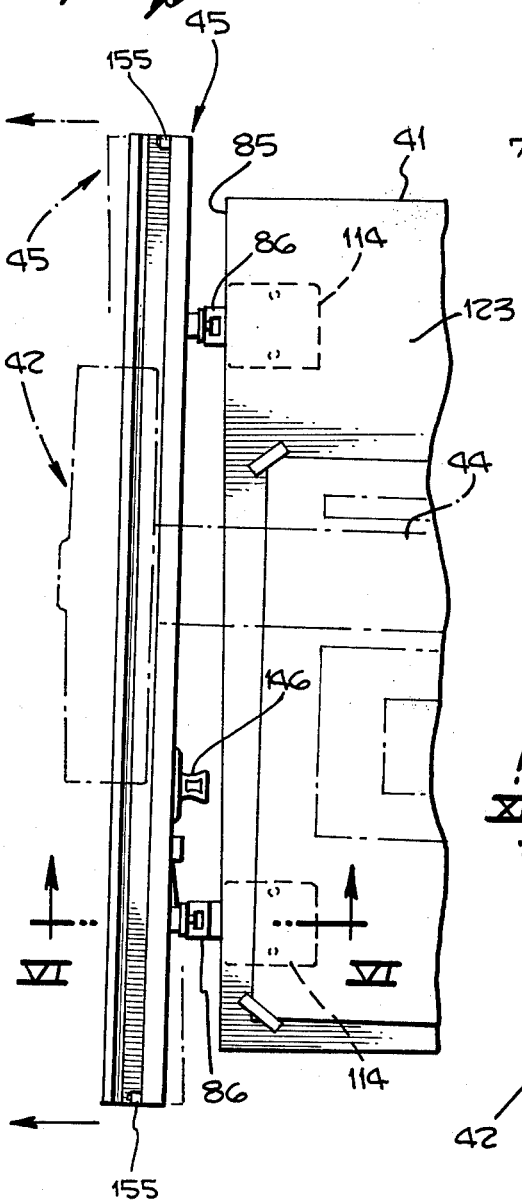
FIG. 2 is a fragmentary top plan view of FIG. 1 showing the drafting apparatus adjusted to align the T-square of the apparatus with a line of a drawing secured to the drawing board at a slight angle.

Means for angular adjustment of T-square 42 relative to the drawing board 41 is best shown in FIGS. 1, 2 and 6. In FIG. 1, guide track means 45 is supported in spaced relation from side edge portion 85 of board 41 by spaced mounting means 86 adjacent the bottom and top margins of board 41. Before describing in detail mounting means 86, it should be noted that track means 45 comprises a longitudinal extrusion, such as aluminum alloy, having a length greater than side edge portion 85 of board 41 as shown in FIG. 1.

Track means 45 includes a vertical web 87 provided with laterally disposed top and bottom facing channels 88 and 89 for slidably receiving therebetween armature strip 51. One face of web 87 may be provided with spaced parallel longitudinally extending guide ridges 90 for positioning armature strip 51. Beneath bottom channel 89, web 87 is provided with a lateral longitudinal flange 92 which terminates in an inverted V-section track edge 93 serving as a track for spaced wheels 94 carried by T-square head member 43 as later described.

On the opposite side of web 87 may be provided top and bottom opposed V section way means 96 and 97 for slidable reception of a circular way element 98 of a mounting member 99. Mounting member 99 is vertically adjustable along mounting bracket 101 of mounting means 86. Mounting bracket 101 comprises a vertically disposed square cross-section portion 102 providing thru passageway 100 and has a vertical centrally disposed slot 103 in the side wall adjacent member 99 for slidable reception therein of spaced lugs 104 the inboard face of member 99. Extending through member 99 is a screw bolt 105 having attached thereto a guide block or nut 106 movable in passageway 100 in the square section bracket portion 102.

Bracket means 101 also comprises a horizontal arm 108 attached to portion 102 in off center relationship. Arm 108 includes top and bottom longitudinal recesses 109 and 110 terminating at the remote end of arm 108 in transverse top and bottom walls 111 and 112. Arm 108 is longitudinally adjustably received within a hollow bracket housing 114 secured in selected position on the bottom surface margin of board 41 by suitable screws 115. The bottom wall of bracket housing 114 includes a depending hollow boss 116 provided with a nut 117 welded thereto for threaded engagement with an adjustment wing headed screw bolt 118 having an internal foot 120 for pressure engagement against arm 108 as at 121 to secure bracket 101 in selected position.

In assembly of mounting means 86 with board 41, it will be understood that track means 45 is not yet engaged with the way elements 98. The top edge 99*a* of member 99 is brought into alignment with the plane of the top surface 123 of the board as indicated by a straight edge instrument in phantom lines in FIG. 4. When such alignment is achieved, screw bolt 105 is tightened so that adjustable block 106 secures the way mounting member 98 in such planar relation with the top surface 123 of the drawing board.

When mounting members 99 of both mounting means 86 have been set and secured, track means 45 may be longitudinally moved to engage way means 96, 97 with members 99. The top edge of the track means 45 is now also in the plane of drawing surface 123. Mounting members 99 serve as gauges to assure accurate parallel relation of the track with drawing surface 123.

Angular adjustment of track means 45 with the side edge 85 of the drawing board is readily accomplished after the track means is assembled with mounting means 86 by loosening the nut 119 and laterally extending arm 108 to selected spaced relationship with edge 85 to adjust alignment of blade 44 with a reference line on a drawing on the board. Tightening of adjustment bolt 118 secures the track means in such angular relation. It will be understood that both mounting means 86 adjacent the top and bottom edges of the board are similarly constructed. One or both mounting adjustment means 86 may have to be adjusted, although usually only either the top or the bottom means 86 is adjusted because of the tolerances available between the bracket housing 114 and the arm 108 and the distance between the spaced mounting means 86. Normally, a reference line on the drawing attached to the board is almost parallel to the edge of blade 44.

In FIG. 2, guide track means 45 is shown angularly adjusted by extension of the lower arm 108 of the lower mounting means 86. In this figure, phantom lines indicate similar angular adjustment of track 45 in the event arm 108 of mounting means 86 at the top of the board is extended laterally. Also, a misaligned sketch attached to the board as illustrated in FIG. 2 is a situation in which such angular adjustment of track means 86 relative to edge 85 is required.

LONGITUDINAL ADJUSTMENT OF TRACK MEANS RELATIVE TO THE DRAWING BOARD

Figure 3:
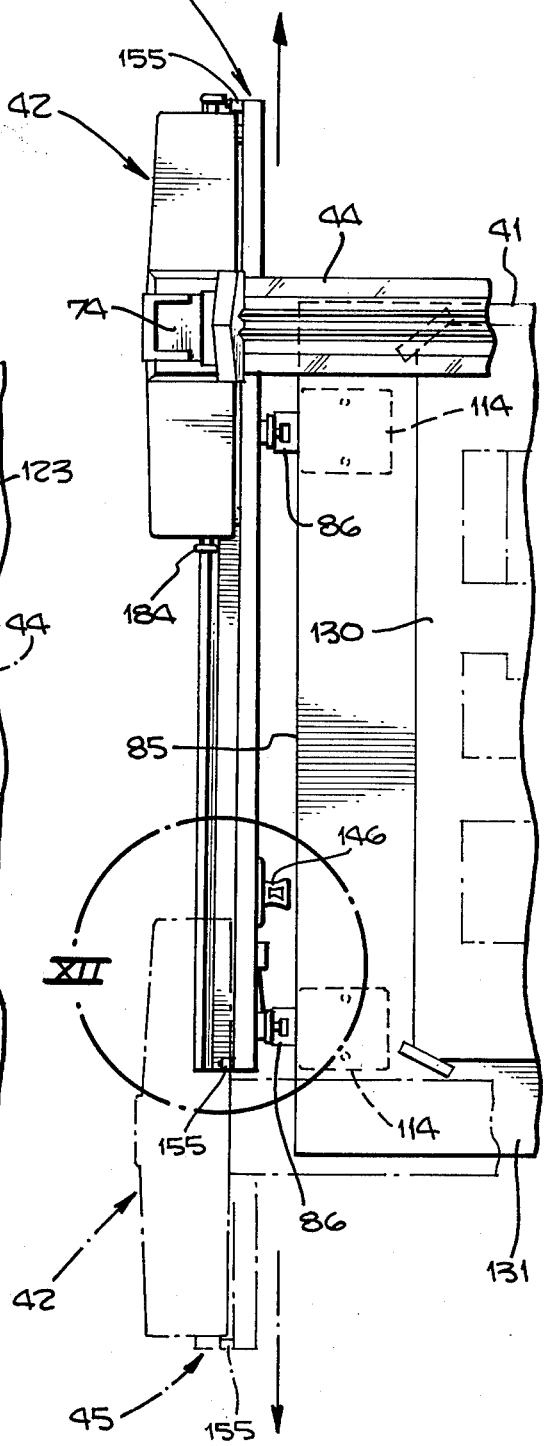
FIG. 3 is a fragmentary top plan view of FIG. 1 showing adjustment of the drafting apparatus of this invention longitudinally of the side edge of the board at both top and bottom for use of the T-square at top and bottom margins of the board.
Figure 7:
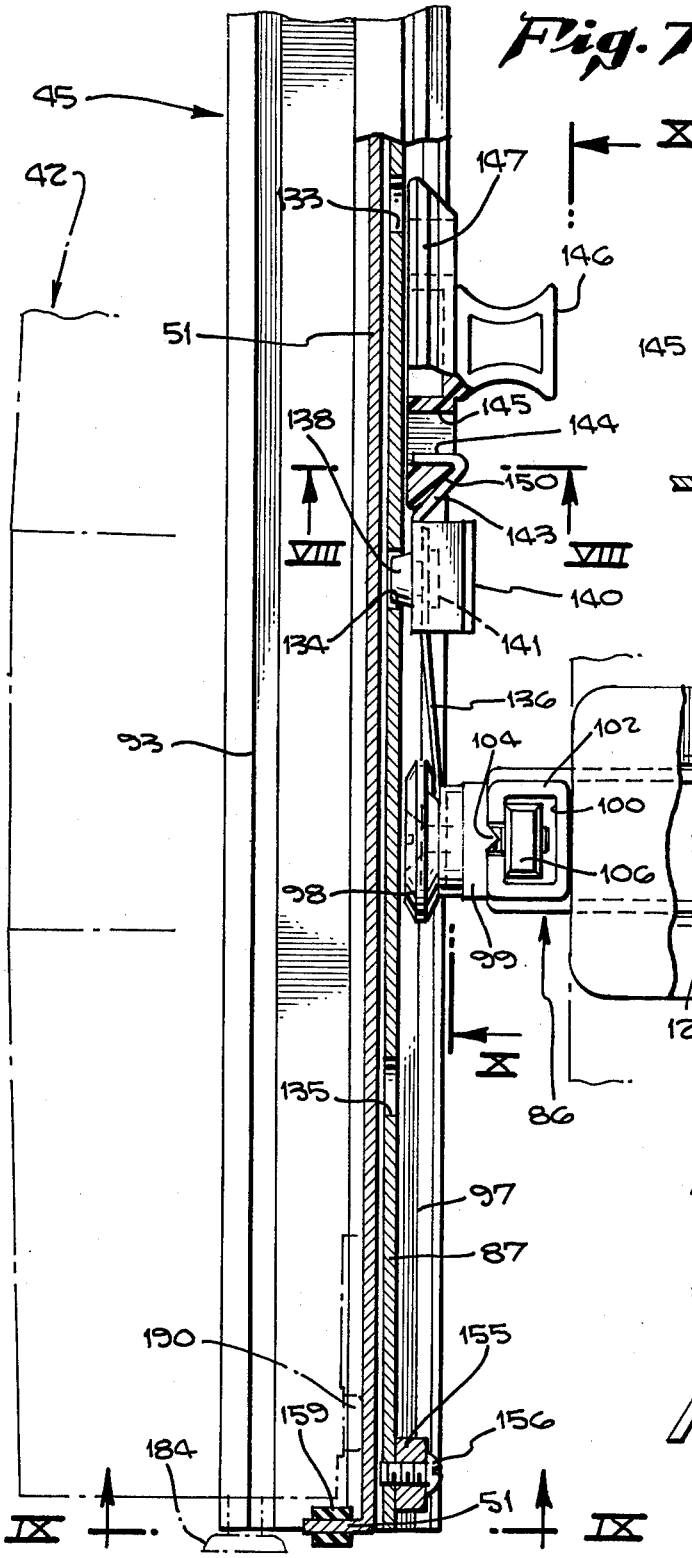
FIG. 7 is an enlarged fragmentary sectional view taken in the plane indicated by line VII—VII of FIG. 4 and showing means for longitudinal adjustment of the apparatus relative to the drawing board.
Figure 8:
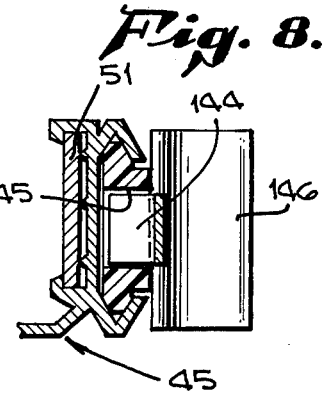
FIG. 8 is a fragmentary sectional view taken in the plane indicated by line VIII—VIII of FIG. 7.
Figure 9:
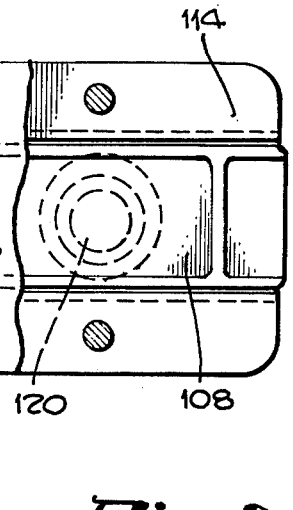
FIG. 9 is a fragmentary end view of the apparatus shown in FIG. 7.
Figure 9:
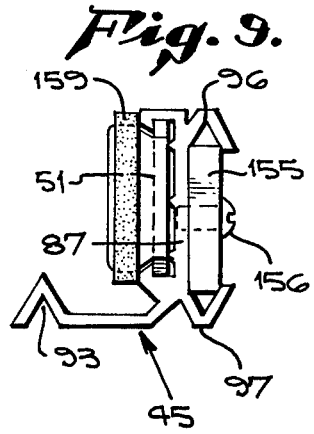
Figure 12:
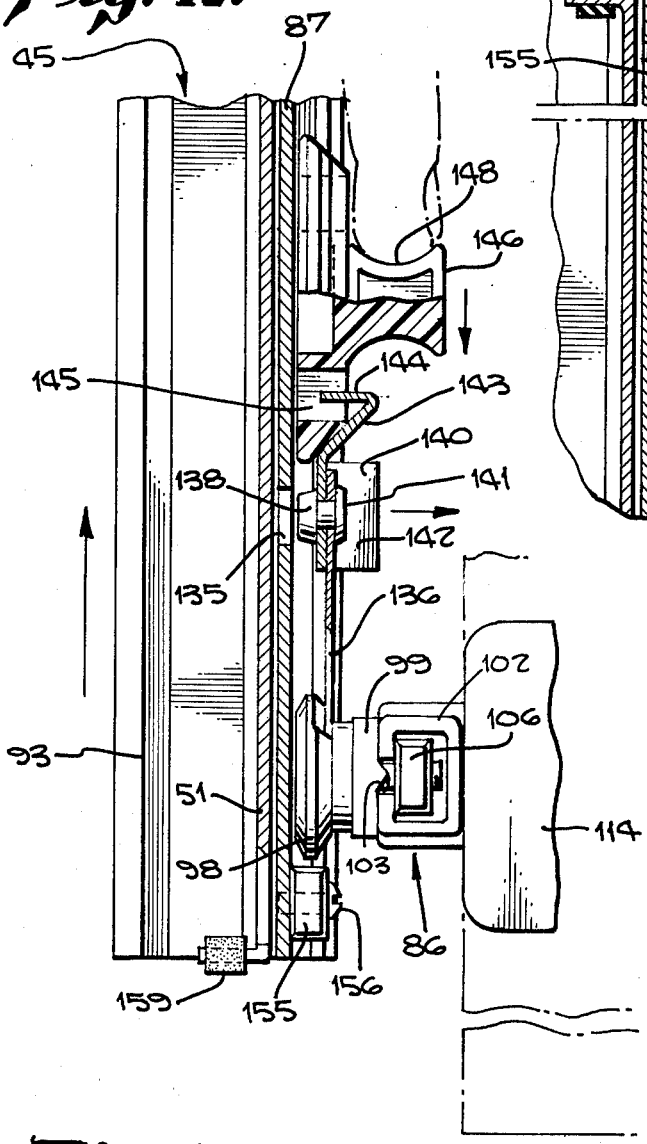
FIG. 12 is a fragmentary sectional view taken at the bottom end of the apparatus in the area designated by phantom circle in FIG. 3 hereof.
Figure 11:
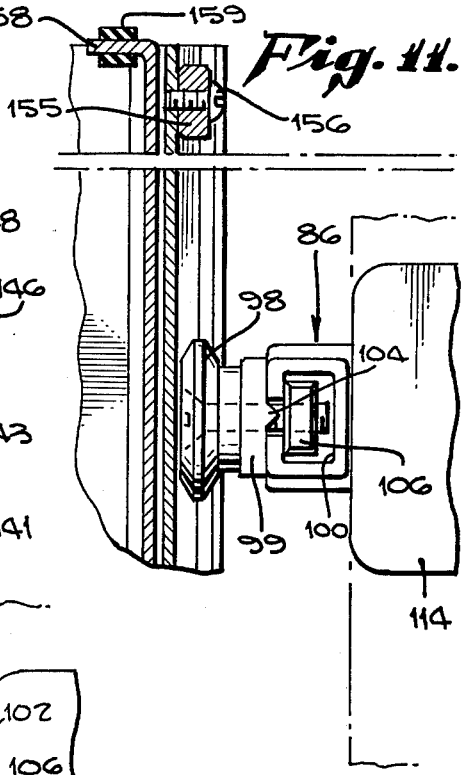
FIG. 11 is a fragmentary sectional view of the upper end of the apparatus as shown in FIG. 1 as designated by the phantom circle in FIG. 1.
Figure 10:
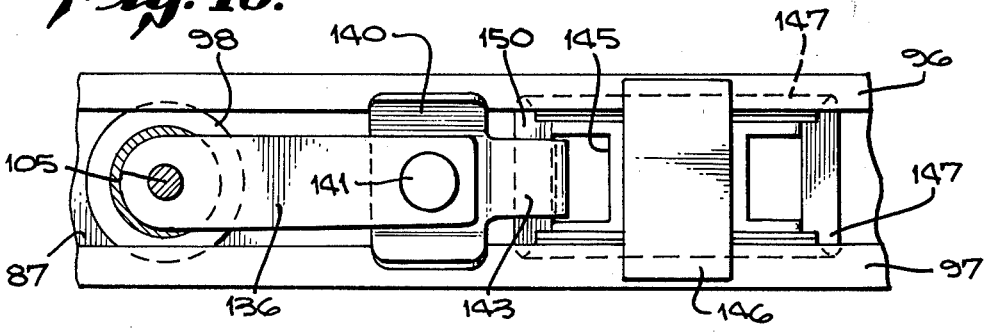
FIG. 10 is a fragmentary elevational view taken in the plane indicated by line X—X of FIG. 7.

Longitudinal adjustment of track means 45 to provide full bearing support of the head body member 43 of the T-square against the track means when the T-square is used adjacent top and bottom margins of the drawing board is best shown in FIG. 3, FIG. 7 and FIG. 12. In FIG. 3, track means 45 is longitudinally adjusted upwardly so that blade 44 may be used at top margin 130 of the drawing board and yet be fully supported by head body member 43 in full length relation with track means 45. FIG. 3 also shows in phantom lines the longitudinal displacement of the track means 45 downwardly for full use of the blade 44 adjacent bottom edge margins 131 of the drawing board. Displacement of track means 45 relative to mounting means 86 and side edge 85 is provided in a selected number of positions as provided, in this example, by three index holes 133, 134 and 135 in selected spaced relation in web 87 of the track means. In FIG. 7, index hole 134 is used for normal longitudinal positioning of the track means relative to side edge 85 of the board. To lock guide track means 45 in such normal position, a spring hasp 136 is secured at one end by providing a port through which screw bolt 105 of the mounting member 99 extends, FIG. 10. Hasp 136 carries at its opposite end a laterally extending loss or button 130 normally biased by hasp 136 into index hole 134 (FIG. 7).

Means to release button 138 from index bole 134 includes a latch element 140 secured to hasp 136 by indexing button 130 and its securement rivet 141. The latch release element 140 includes upwardly and downwardly extending bent wing portions 142 and a cam portion 143 extending longitudinally of the hasp and provided with an inturned latch end section 144 for reception in an opening 145 in a latch release member 146. Latch release member 146 is guided along way means 96 and 97 by top and bottom edge portions 147 which engage the top and bottom way means 96 and 97. Latch member 146 includes suitably contoured surfaces 148 to readily accept the contour of a finger. In FIG. 7, which shows the hasp and index button 138 in engaged position with index hole 134, end section 144 is shown fully inserted in opening 145 and cam portion 143 resting on a cam surface 150 of the latch member 146. When the latch member 146 is pressed in the direction of the way means, cam surface 150 urges end section 144 laterally to a release position of the lock button 138 from hole 135 as shown in FIG. 12. Upon such release from the index hole 135, the entire guide track means 45 may be longitudinally displaced until either index hole 133 or 135 is opposite the index lock button 138, at which time hasp 136 will bias button 138 into the selected index hole 135 or 133.

It should be noted that the means for locking the track in such longitudinal displaced relation with the board is required at only one end of the mounting means 86, the upper mounting means 86 not requiring association with such an index lock means and release means.

It may be noted that the way means provided on track 45 for the mounting means is also provided with suitable stop means 155 at each end of the track. Such stop means may include a suitable block of material secured in the way means by a set screw 156. It may also be noted that armature strip 51 has its ends 158 laterally turned and provided with a resilient bumper 159 for limiting travel of the T-square at the ends of the track means. Strip 51 may be suitably secured in track means 45 against longitudinal relative movement.

ADJUSTMENT MEANS FOR BOARD THICKNESS

Means for adjusting track means 45 to accurately relate the T-square with drawing boards of different thickness is illustrated in FIGS. 4–6, inclusive. The mounting means 86 has been described in detail with respect to FIG. 6 in which a board thinner than the boards of FIGS. 4 and 5 are illustrated. As previously mentioned, the square section guide portion 102 of mounting bracket 101 and extension arm 108 are unsymmetrically related in that arm 108 joins portion 102 in offset center relation. In the board thickness of FIG. 6, adjustment of way mounting member 99 so that its top gauge reference edge was in the same plane as plane 123 of the board was described.

In FIG. 4, which illustrates a board having a thickness greater than the board in FIG. 6, it is readily apparent that the mounting member 99 and with guide block 106 may be moved relative to the portion 102 along the slot 103 and then secured with the top edge 99*a* of member 99 lying in the same plane as plane 123 of the board. When the way member 99 is secured in this manner by tightening screw bolt 105, the top edge of the track means 45 will also lie in the same plane as plane 123 of the board. Thus, with respect to certain thicknesses of board, mounting bracket 101 permits some adjustment for board thickness.

However, in the example of a much thicker board, such as shown in FIG. 5, the offset relationship of arm 108 with portion 102 permits reversal of the short end of portion 102 to the long end thereof by simply withdrawing arm 108 from the bracket housing 114, reversing bracket 101, and reinserting arm 108 into the housing 111. This is readily accomplished by releasing the adjusted bolts 118 of both bracket mounting means 86.

After reversing the position of mounting bracket 101, as shown in FIG. 5, it will be apparent that additional adjustments may be made of mounting element 99 for additional different thicknesses of drafting boards. It will also be apparent that aligning top edge of mounting element 99 with the plane of a drafting board surface by means of any straight edge instrument also automatically assures that guide track means 45 will be in proper relationship to the drawing board surface when it is mounted on the track mounting elements 98.

ADJUSTMENT OF T-SQUARE FOR PAPER THICKNESS

Means for adjusting the T-square on track means 45 for different thicknesses of paper or graphic materials which might be used on a drafting board is best shown in FIGS. 13 and 16–21. It should be noted that head body member 43 of the T-square 42 is rollably supported and movable along the track by spaced wheels 94 provided at each end of body member 43. Each wheel 94 is carried by an axle 170 which projects beyond the wheel on opposite sides for reception in a longitudinally movable yoke 171 having spaced parallel walls 172 longitudinally slidably movable in guide recesses 173 and 174 provided in internal partition walls of the head body member. Such partition walls 175 and 176 provide vertical slots 177 and 178 for reception of the projecting ends of the axle 170 to permit vertically displacement of the axle and wheel. Each wall 172 of the yoke is provided with an inclined slot 180, the upper edges of which are formed with a plurality of spaced part-circular indentations 181 adapted to receive and position axle 170. Yoke 171 is provided with an end wall 183 from which projects a knob 184 adapted to be manually grasped for displacing yoke 171 longitudinally.

As shown in FIG. 17, where a thin material is being employed on the surface of the drawing board as indicated by the thickness "a", axle 170 is positioned in the yoke indentations 181 at the top of the inclined recess 180.

When a material is being used on the drafting board having a thickness such as "b", yoke 171 may be pulled longitudinally outwardly of the end of the T-square body member to cause the axle 170 to be cammed into the middle indentation 181 thereby raising the T-square body member into greater spaced relation with track 93 and to permit the blade 44 to lie in close parallel relationship with the top surface of the thicker drawing material.

As shown in FIG. 19, when the thickness of the material on the drawing board is that indicated by "c", the yoke 171 may be urged further outwardly to displace the axle into the lowermost indentation 181 and to thereby further increase the height of the head body portion member with respect to the top edge of the guide track and also to permit the bottom surface of blade 44 to be in close parallel relationship with the top edge of the thicker drafting material.

It will thus be apparent that the yoke 171 serves in effect as a means for jacking or raising the head body portion into increased spaced relationship with the fixed guide track means 45 and rail 93.

In assembly of the yoke 171 and wheel 94 with the housing body member, it will be understood that such assembly may be readily made with the upper housing portion removed from the lower housing portion to permit the axle 177 to be readily dropped into the vertical slots 177, 178 provided in the lower housing portion partitions. With the upper housing portion removed, the yoke 171 may be readily assembled with the wheel and axle and lower portion so that when the housing portions are secured together by suitable means, the yoke and wheel assembly will be retained in assembly.

It will thus be apparent that the body member of the T-square means is readily rollable along the V section track means 93 in a smooth free manner when the magnet means are disengaged. To provide further alignment of the body member with the track means and armature strip 50, suitable spacer buttons 190 may be provided adjacent each end of the body member for low friction sliding engagement with the opposed face of the armature strip 51.

T-SQUARE BLADE MEANS

Blade 44 of the T-square may be suitably attached to the head body member 43, in this example as best seen in FIGS. 13, 22, and 25. At the top central portion of upper housing body 48 is provided upwardly facing recess opening 195. End portion 196 of blade 44 extends into said recess opening 195 and may be provided with an opening 197 coinciding with opening 198 in the wall of the recess opening 195 and through which actuator portion 60 upwardly extends. On the top surface of end portion 196 is also provided a securement plate 199 having an opening 200 aligned with the openings 197 and 198. The forward end of plate 199 is provided with upwardly offset opposed tabs 201 adapted to overly and to secure end portion 203 of an accessory blade guide 204. End 203 is secured by suitable screws 205 and plate 199 and end portion 196 of the blade may be suitably secured by screws 206. Extending over the upwardly facing recess 195, the end portions 196 of blade 44 and plate 199, and end portion 203 of accessory guide 204 may be a suitably configured shroud or cover 207 provided with an opening 208 for reception of cap 67. The cover 207 may be secured at recessed opening 195 in suitable manner as by screws (not shown).

Blade guide 204 may be a suitable extrusion having a selected rib configuration 210 providing longitudinally thereof a groove 211 which extends for the length of blade 44. As illustrated in FIGS. 14 and 15, groove 211 serves as a guide track for various drafting accessories, one example of such an accessory being a rule 214 having a depending beaded rib 215 of smaller diameter than groove 211. The beaded edge of rib 215 may receive a longitudinally sleeve element 216 of suitable low friction material to facilitate facile sliding of rule 214 along blade 44.

In FIG. 15, it will be noted that edge 217 of rule 214 extends beyond the longitudinal edge of blade 44 and may serve as a straight cutting edge, if desired. Rule 214 may be made of an extruded aluminum section to provide a hard cutting edge 217 or a separate metal shield may be secured to the longitudinal portion of rule 214 to provide such hard cutting edge. Rule 214 may be provided with suitable scale indicia.

DRAFTING BOARD SUPPORT

Figure 28:
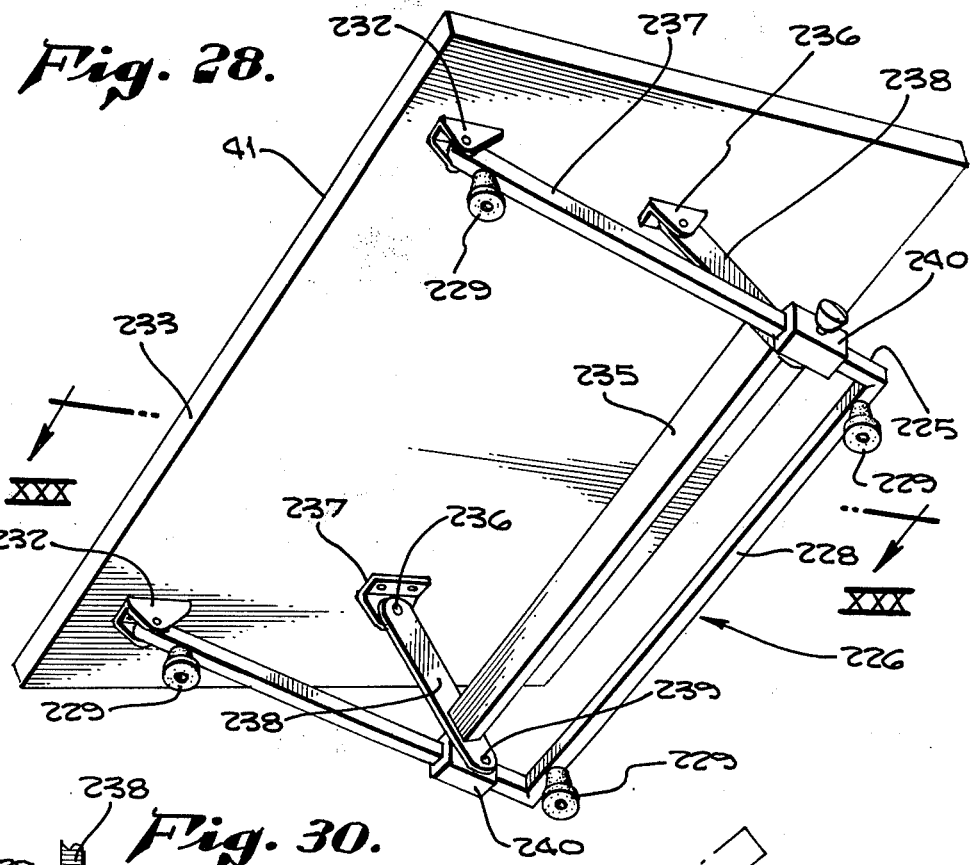
FIG. 28 is a perspective view of a support means for a drafting board and providing inclination adjustment means.
Figure 30:
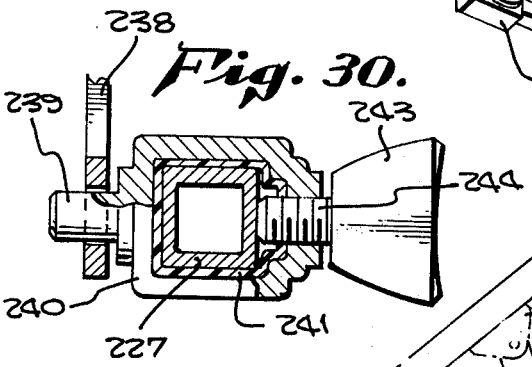
FIG. 30 is an enlarged fragmentary sectional view taken in the plane indicated by the line XXX—XXX of FIG. 29.
Figure 29:
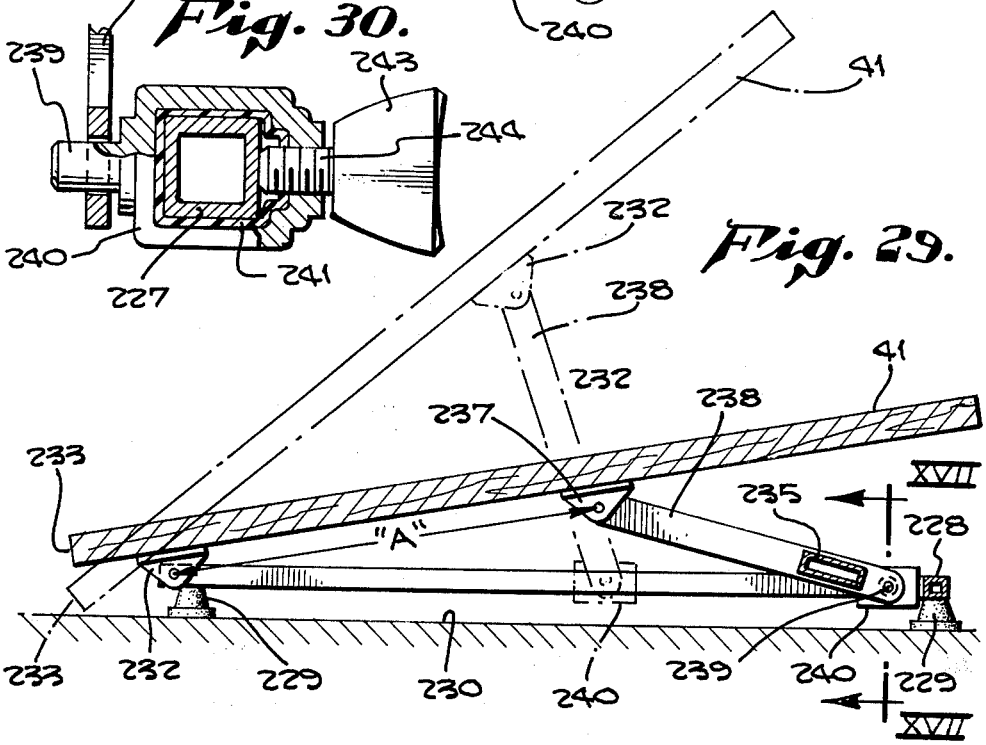
FIG. 29 is a sectional view taken in the plane indicated by line XXIX—XXIX of FIG. 28 and showing in phantom lines the drawing board adjusted to a selected inclined plane.

In FIGS. 28–30, drafting board 41 is shown with an adjustable stand or support to conveniently regulate the angle of inclination of the drawing board as indicated in phantom lines in FIG. 29. The drawing board support generally indicated at 225 may comprise a U-shaped frame 226 having side members 227 and a transverse end member 228 made of suitable square tube section stock. Members 227 and 228 may have secured thereto at suitable points rubber feet 229 for supporting frame 226 on a surface 230. The free end of each side member 227 may be pivotally connected at 231 to a suitable bracket 232 secured adjacent the bottom edge 233 of the board.

Intermediate the top and bottom edges of board 41, a generally H-shaped frame 235 may be pivotally connected as at 236 to a suitable brackel 237 secured to the bottom surface of board 41 a predetermined distance A from bracket 232. Legs 238 of H frame 235 may be pivotally connected at 239 to an open ended slide 240. Slide 240 is provided with an internal low friction square section bearing sleeve 241 adapted to slidably receive a square tube side member 227 of frame 226. An adjustable wing-headed bolt 243 extends through slide 240 in threaded connection therewith for pressure engagement at 244 with side member 227.

In this example, the brackets 237 are located so that when the board 41 is at approximately 10° to the horizontal, slide 240 will bear against transverse member 228 as a stop means. The location of bracket 237 provides in this example, for a maximum angle of inclination of approximately 40° as indicated by phantom lines when the slides 240 are approximately located as shown in FIG. 29. When the slide is at intermediate positions along the side members 227, tightening of the bolts 243 will secure the H frame in selected position.

Drawing board 41 may be located in substantially parallel relation to the U-shaped frame 226 by sliding the legs 238 forwardly so that slides 240 are adjacent brackets 232. For this purpose, the length of legs 238 are less than the distance "A" or the distance "A" is selected as greater than the length of leg 238. Thus placement of bracket 237 is critical to provide 10° inclination and a stop at 228, while also providing collapse of board and frame to compact parallel relation.

Drafting apparatus 40, as described above, provides several advantages to a draftsman in setting up his drafting board for various graphic media and for adjusting the relationship between a T-square an the board for variable conditions. It will be understood that the assembly of the drafting apparatus of this invention with a drawing board may require adjustments only at the time of the initial set up or installation of the drafting apparatus with the board, as for example when the apparatus is applied to a board of certain thickness. During actual use of the drafting apparatus, it is readily apparent to those skilled in the art that the T-square and track are readily adjustable to other conditions that might be met by the draftsman in the use of the T-square and drawing board, as for example the longitudinal displacement of the track means relative to the board, and the variation in height of the T-square from the track means to accomodate the apparatus to drawing media of different thickness used on the surface of the drawing board. It will also be apparent that the manner of pivotally mounting the magnet means and their actuation to release position facilites convenient rapid use of the T-square. The wheel mounted T-square is readily accurately adjusted to different positions without loosing the alignment of the T-square blade with the drawing.

It will be understood that various changes and modifications will be made in the drafting apparatus described above which come within the spirit of this invention and all such changes and modifications coming within the scope of the appended claims are embraced thereby.

What is claimed is:

1. A drafting apparatus for use with a drawing board having a side edge portion and a planar drawing surface comprising, in combination:

guide track means mounted on said board in spaced relation to said side edge portion;

a strip of magnetic material carried by said guide track means and extending longitudinally thereof;

T-square means having a head body member and a blade member arranged in 90° relation;

means on said head body member cooperable with said guide track means for movement of said T-square means along said guide track means;

said cooperable means including magnet means carried in said head body member and cooperable with said strip of magnetic material for holding said T-square means in a selected position;

and means on said head body member pivotally mounting said magnet means about a longitudinal axis parallel to said side edge portion for release of said magnet means from a holding position.

2. A drafting apparatus as stated in claim 1 wherein said means pivotally mounting said magnet means includes an elongate bar member carrying said magnet means in spaced relation, and a longitudinally extending pivot element on said elongate member cooperable with a pivot element on said head body member and providing a pivot axis.

3. An apparatus as stated in claim 2 wherein said elongate member includes an actuator portion for moving said elongate member about said pivot axis.

4. An apparatus as stated in claim 2 including lock means for holding said actuator portion of said elongate member in magnet release position.

5. An apparatus as stated in claim 4 wherein said lock means includes a slide lock element carried by said actuator portion;

and a cover member carried by said head body member and engageable by said slide lock element for holding said elongate bar member in magnet release position.

6. A drawing apparatus as stated in claim 1 wherein said cooperable means includes spaced wheels on said head portion for rolling contact with said guide track means.

7. An apparatus as stated in claim 1 including quide means on said blade member adapted to cooperate with a blade accessory member slidable therelong.

8. An apparatus as stated in claim 1 including means for mounting said guide track means for displacement relative to said side edge portion of said drawing board.

9. An apparatus as stated in claim 8 wherein said mounting means includes means for aligning said blade member with a line of a drawing on said board.

10. An apparatus as stated in claim 8 wherein said mounting means includes means for adjusting the elevation of said guide track means to coincide with the plane of said drawing board surface.

11. An apparatus as stated in claim 8 including means for displacing said guide track means longitudinally relative to said side edge portion of said drawing board.

12. An instrument as stated in claim 7 wherein said blade accessory member includes means slidably cooperable with said guide means on said blade member, said accessory member including a hard edge spaced from the edge of the blade member.

13. An apparatus as stated in claim 9 wherein said alignment means includes extendable arms on said mounting means, each arm adapted to move said guide track means into selected spaced relation with said side edge portion.

14. An apparatus as stated in claim 10 wherein said elevation adjustment means includes a clamp nut connected with a way element cooperable with said track means;

a mounting member having vertically disposed means receiving said clamp nut for permitting vertical displacement of said track means with respect to the drawing board surface to accommodate different thicknesses of said board.

15. An apparatus as stated in claim 11 wherein said longitudinal displacement means includes selectively spaced index ports at one end portion of said guide track means, and means for releasable engagement with said index ports to permit longitudinal displacement of said track means and to retain said track means in such displaced position.

16. An apparatus as stated in claim 1 wherein said guide track means includes opposite facing longitudinal channels receiving said strip of magnetic material.

17. A drawing instrument comprising a T-square means provided with:

a head member and a blade member at right angles therewith;

said head member comprising a head body having spaced recesses along its inboard edge; p1 magnets in said recesses with faces directed inboardly and exposed;

and means connecting and pivotally mounting said magnets about a horizontal axis parallel to said inboard edge to provide partial and full release of said magnets from a cooperable track means having magnetic material.

18. A drawing instrument as stated in claim 17 wherein said pivotal mounting means includes a releasable lock member cooperable with means on said head member for holding said magnets in release position.

19. A guide track means for a drawing instrument adapted to be secured to an edge of a drawing board including:

a longitudinally extending vertical web having longitudinal vertical side faces;

a longitudinally extending track spaced from and parallel to one of said side faces and connected to the bottom edge portion of said web; and a longitudinally extending way means provided on the opposite side face of the web and providing opposed longitudinal recess means connected to top and bottom longitudinal edge portions of said web and adapted to receive spaced mounting way elements carried by mounting means secured to the drawing board.

20. A quide track means as stated in claim 19 including:

longitudinally spaced ports in said web;

mounting means on said drawing board associated with said way means;

and positioning means carried by said mounting means and cooperable with said spaced ports in said web for longitudinally displacing said track means relative to said drawing board.

21. In a drawing instrument including a T-square means adapted to be guided on a guide track means and including a head body member and a blade member adapted to overly a drawing board surface, the provision of:

wheel means at opposite ends of said head body member;

and means carried by said head body member for vertical adjustment of the axis of said wheel means relative to the head body member for adapting the blade member to different thicknesses of drawing material on a drawing board.

22. A drawing instrument as stated in claim 21 wherein said adjustment means includes a yoke member at each end of said head body member;

slot means in said yoke member engageable with an axle of a guide wheel;

said slot means being inclined and having spaced indentations along one edge thereof cooperable with said wheel axle;

said yoke member being movable to change the cooperable engagement of said axle with said slot means and indentations therein for varying the relative height of said head body member with respect to said guide track means.

23. In combination with a drawing board, the provision of:

support means for said board including a U-shaped frame having side members, free ends of said side members being pivotally connected to said board;

an H frame having side legs, one end of which are pivotally connected to said board intermediate top and bottom edges thereof;

slide means carried by the other ends of said legs and pivotally connected thereto;

said slide means being movable along said side members to selected positions for adjusting inclination of said board;

and bolt means carried by each slide means for securing said slide means in selected position on said side frames.

24. Means as stated in claim 23 wherein said slide means include a low friction material bearing sleeve.

25. A T-square means comprising:

a head member and a blade member at right angles therewith:

said head member comprising a generally hollow head body having spaced recesses along its unboard edge:

a bar within and extending longitudinally of said housing;

spaced magnets carried by said bar for reception in said spaced recesses and extending beyond the longitudinal face of said head body;

said bar having a longitudinally extending rib cooperable with means on said head body to provide a longitudinal axis for pivotal movement of said bar;

and means on said head body for moving said bar about its longitudinal pivot axis.

26. A T-square means as stated in claim 25 wherein said bar includes a top longitudinally extending rib;

and means on said head body for abutment with said rib to position said bar with the faces of said magnets in a vertical plane.

27. A T-square means as stated in claim 25 wherein said means for moving said bar about said longitudinal pivot axis includes;

an upstanding actuator portion centrally of said bar;

and means carried by said head body for engagement with said upstanding actuator portion.

28. A T-square means as stated in claim 27 wherein said means for engagement with said upstanding actuator portion includes:

a slideable lock element to hold said bar and magnets in release position.

* * * * *